United States Patent [19]

Strongin et al.

[11] 4,033,071

[45] July 5, 1977

[54] SUCKING DOLL WITH CHEEKFLEXING MEANS OPERATED BY TURNING BOTTLE

[76] Inventors: Ned Strongin, 936 Willowbend Lane, Baldwin, N.Y. 11510; A. Edward Fogarty; Bonnie Rose Fogarty, both of 3513 School Ave., Sarasota, Fla. 33579

[22] Filed: Mar. 18, 1976

[21] Appl. No.: 668,239

[52] U.S. Cl. ..... 46/118; 46/135 R; 46/141

[51] Int. Cl.[2] ..... A63H 13/02

[58] Field of Search ..... 46/118, 135 R, 141

[56] References Cited

UNITED STATES PATENTS

| | | | |
|---|---|---|---|
| 2,641,866 | 6/1953 | Schiller | 46/118 X |
| 2,686,388 | 8/1954 | Seidl | 46/135 R X |
| 3,250,037 | 5/1966 | Katz et al. | 46/135 R |
| 3,383,795 | 5/1968 | Ryan et al. | 46/135 R |
| 3,406,482 | 10/1968 | Ryan et al. | 46/141 X |

FOREIGN PATENTS OR APPLICATIONS

| | | | |
|---|---|---|---|
| 497,345 | 4/1918 | France | 46/135 R |

*Primary Examiner*—F. Barry Shay
*Attorney, Agent, or Firm*—Edward F. Levy

[57] ABSTRACT

A drinking doll is provided which closes its eyes, draws its cheeks inward to simulate the action of sucking and produces a sucking noise in response to the manipulation of a simulated bottle placed in the doll's mouth. When placed in the mouth the bottle tip becomes mechanically connected to a device in the doll's head which, upon rotation of the bottle, can cause sucking sounds and movement of the eyes and cheeks of the doll.

8 Claims, 10 Drawing Figures

FIG. 2
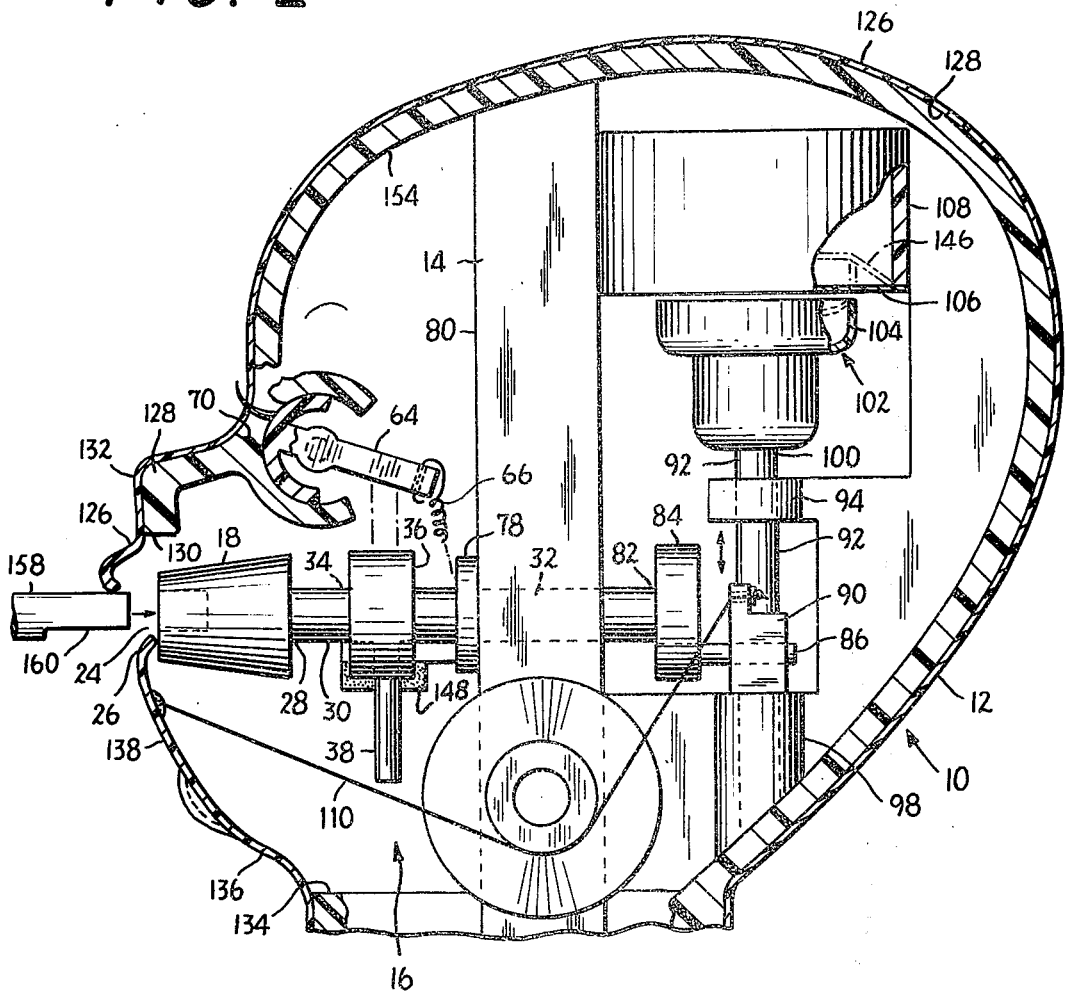
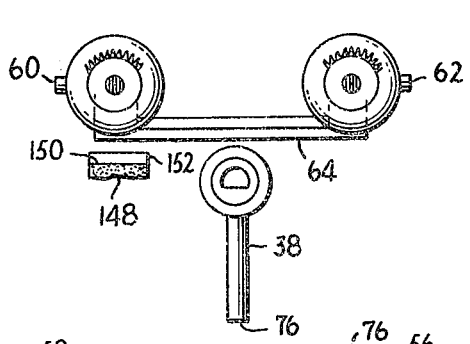
FIG. 3
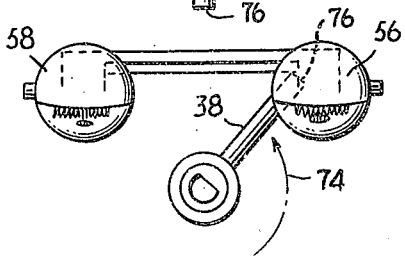
FIG. 3A

SUCKING DOLL WITH CHEEKFLEXING MEANS OPERATED BY TURNING BOTTLE

The present invention relates in general to toys and more particularly, to a doll which simulates the natural actions of an infant feeding from a bottle by closing its eyes and simulating a sucking action with its cheeks while producing a sucking noise.

In response to the desire for even greater realism in children's toys and especially in children's dolls, there has been a continuing desire to provide a doll capable of simulating the action of feeding from a bottle. Conventional dolls adapted for bottle feeding play comprise either a mouth orifice into which a simulated bottle is inserted, or a mouth orifice leading to an internal container which receives fluids poured into the mouth orifice by a child using a miniature bottle. Neither of these conventional dolls simulate the facial expressions or the sound of feeding or sucking.

In contrast to the prior art, the drinking doll, according to the present invention, closes its eyes, appears to drink with a sucking motion of its cheeks and produces a sucking or gurgling sound in response to the manipulation of a special simulated bottle which is placed in the mouth of the doll. The special bottle has a non-circular nipple portion which engages a complementary shaped recess which is formed on the end of a shaft which is rotatably mounted within the head of the drinking doll. Rotation of the bottle in a clockwise direction rotates the shaft and causes a lever attached to the shaft to strike a bar which connects the drinking doll's eyes. Each of the drinking doll's eyes are pivotally mounted in the doll's head. Striking the bar causes the doll's eyes to rotate on the pivots so that eyelash and eyelid portions of the doll's eyes come into registry with eye socket portions which are formed in the doll's head and the doll's eyes thus appear to close. A tension spring attached to the bar provides a restoring force which returns the doll's eyes to the open position.

Rotation of the bottle in the counter-clockwise direction rotates the shaft and rotates an eccentrically mounted member which is mounted on the shaft and which also engages a slotted portion of a slideably mounted block. Rotation of the shaft causes the eccentrically mounted member to raise the block and causes a suction cup which is connected to the block to press onto a membrane which is stretched across a resonant chamber which is mounted within the doll's head. Raising the block also puts tension on a pair of strings, each of which runs from the block, over a guide, to the inside of the cheeks of the drinking doll. The cheeks are made of a resilient plastic and the strings draw the cheeks inward, thus simulating the appearance of sucking. As the bottle is returned to the neutral position, the slideably mounted block is lowered, the tension on the strings is released, the cheeks flex back to their original position and the suction cup is drawn away from the membrane. As the suction cup is drawn away from the membrane there is an inrush of air into the suction cup and this inrush of air combined with the vibration of the membrane which is set up creates a sound which simulates the sound of sucking on a bottle.

It is an object of the present invention to provide a drinking doll which simulates the facial motions of sucking on a bottle.

Another object of the present invention is to provide a drinking doll which simulates the sound of drinking from a bottle.

Another object of the present invention is to provide a drinking doll in which the simulation of the facial motion of sucking on a bottle and the simulation of the sound of sucking on a bottle are presented in a timed relationship.

Another object of the present invention is to provide a drinking doll which closes its eyes.

Another object of the present invention is to provide a drinking doll which closes its eyes, has a sucking action of its cheeks and produces a gurgling sound in response to manipulation of a simulated bottle.

Still another object of the present invention is to provide a drinking doll which contains a few simple parts and which is economical in manufacture.

Additional objects and advantages of the invention will become apparent during the course of the following specification, when taken in connection with the accompanying drawings, in which:

FIG. 2 is a vertical sectional view of the head of the drinking doll according to FIG. 1;

FIGS. 3 and 3A are fragmentary elevation views showing the portions of the operating mechanism of FIG. 1 which relate to the opening and closing of the eyes of the drinking doll;

Figure 1:
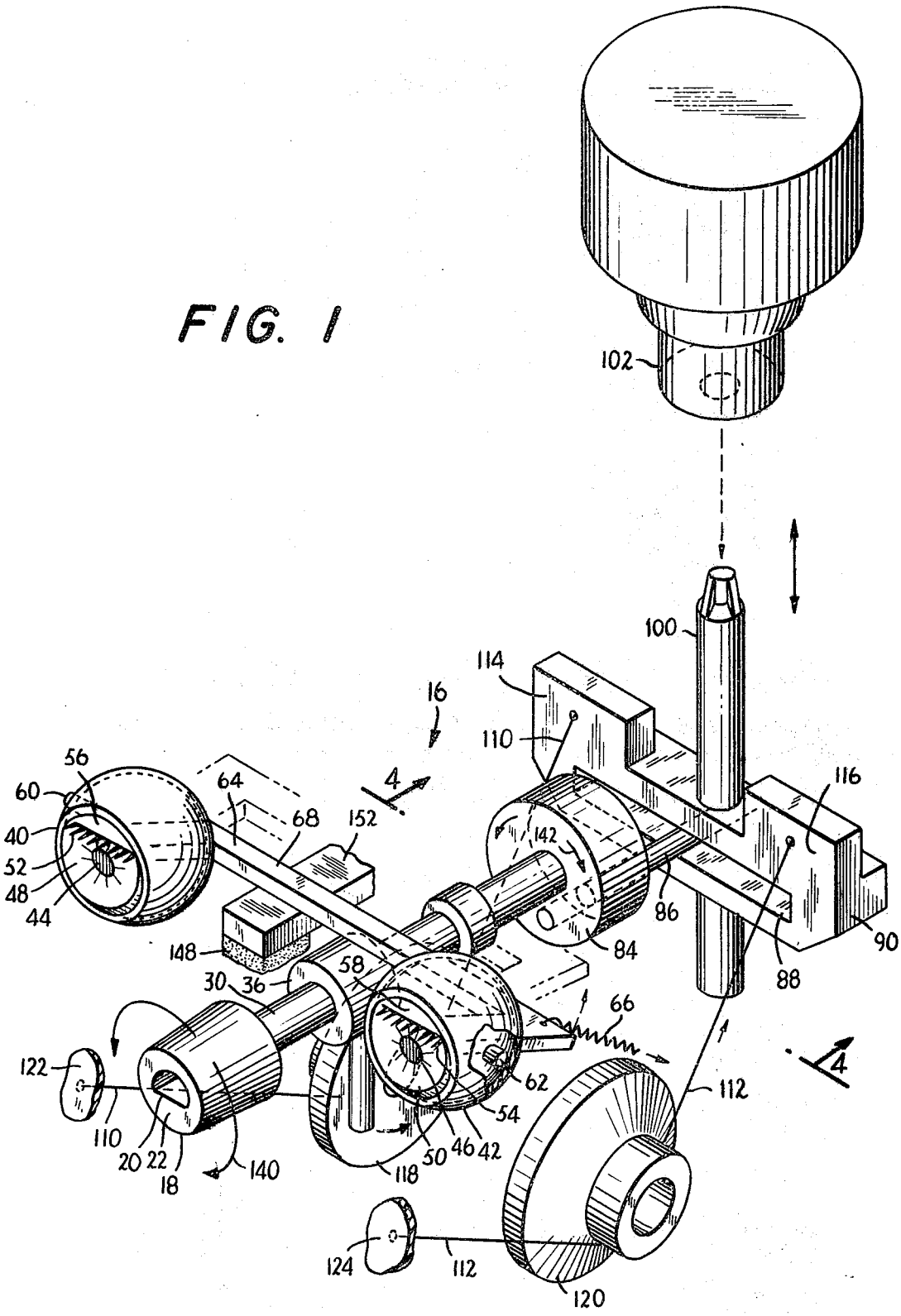
FIG. 1 is a perspective view of the operating mechanism of a drinking doll made in accordance with the present invention.
Figure 4:
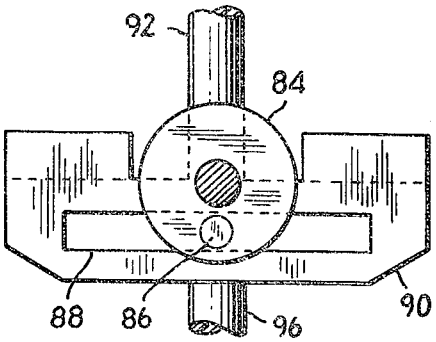
Figure 4A:
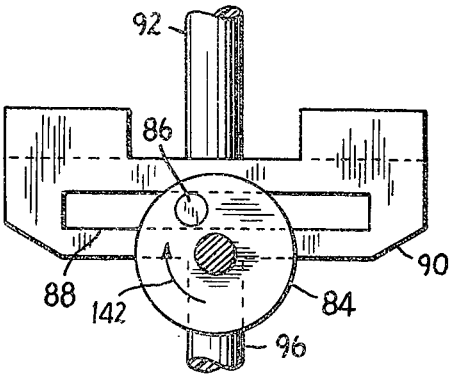
Figure 5:
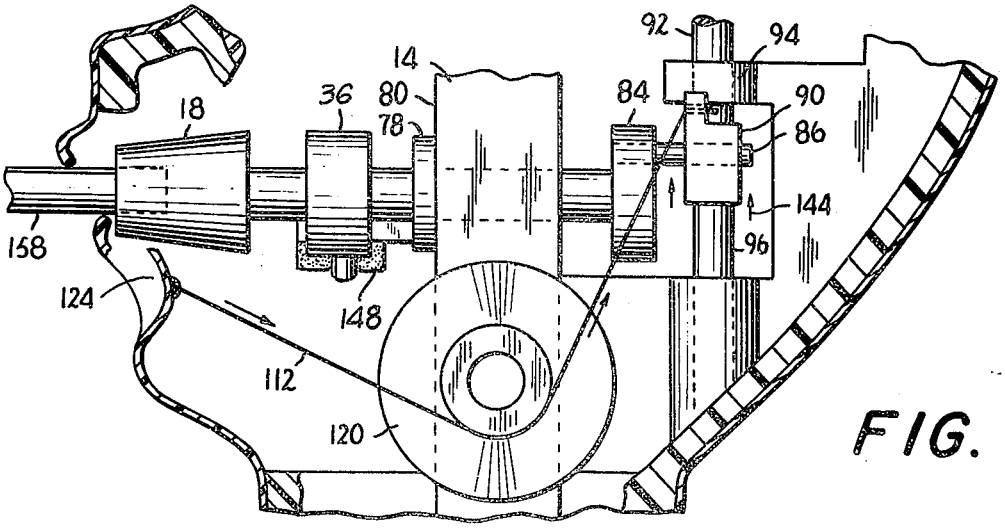
Figure 8:
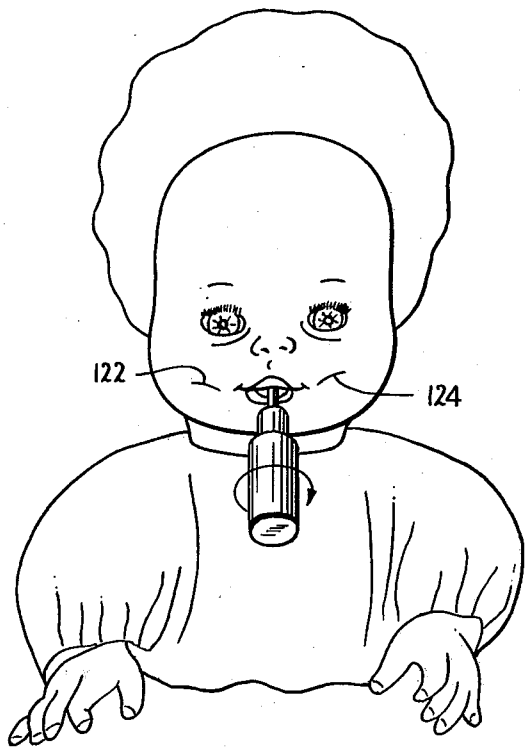
Figure 7:
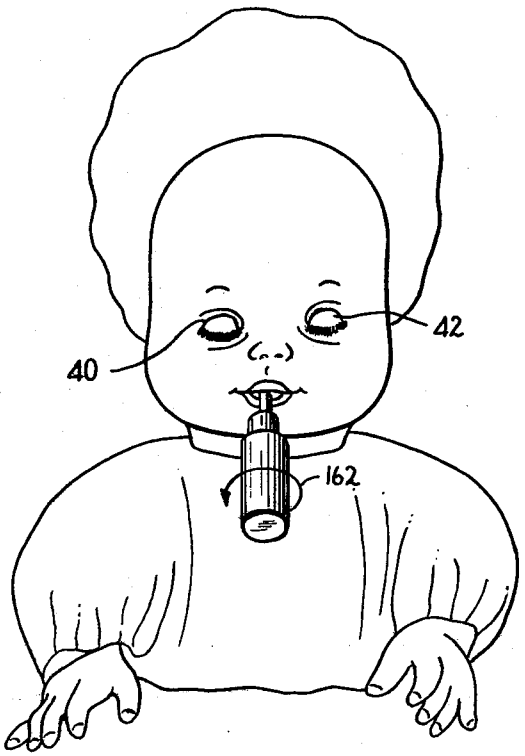
Figure 6:
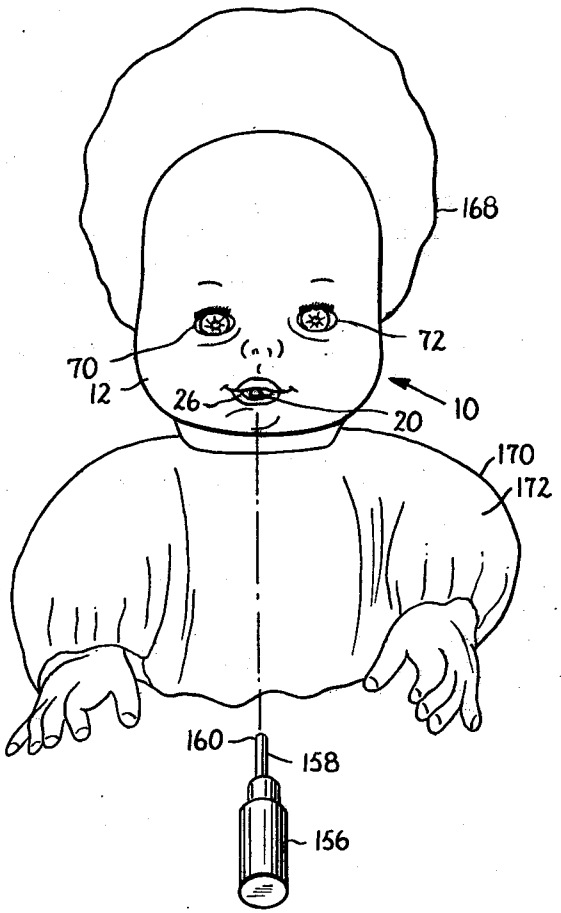

FIGS. 4 and 4A each show a fragmentary elevational view taken along the line 4—4 of FIG. 1 showing the operation of the members, to raise a slideably mounted block;

FIG. 5 is an enlarged fragmentary sectional view similar to FIG. 2 showing the action of the operating mechanism in moving the cheek portions inward to simulate the appearance of sucking;

FIG. 6 is an elevational view of the drinking doll showing a simulated bottle about to be inserted in the doll's mouth;

FIG. 7 is elevational view of the drinking doll similar to FIG. 6 showing the simulated bottle inserted into the doll's mouth and rotated in a counter-clockwise direction thereby closing the doll's eyes; and FIG. 8 is an elevational view of the drinking doll similar to FIG. 7 with the simulated bottle shown rotated in a clockwise direction thereby causing the doll's cheeks to be drawn inward.

Referring in detail to the drawings, there is shown in FIG. 2 the head portion 10 of a drinking doll made in accordance with the present invention. The doll head portion 10 comprises a hollow head 12 within which there is mounted a rigid frame 14 which supports the operating mechanism 16.

The operating mechanism 16 is shown in detail in FIG. 1, and includes a cylindrical or frusto-conical member 18 which has in its front end surface 22 a non-circular aperture 20 which is aligned with an opening 24 formed in the mouth portion 26 of the doll head. The member 18 is attached to the end 28 of a rotatably mounted shaft 30 which extends through a hole 32 in the frame 14. At an intermediate location 34 on the shaft 30 a collar 36 is mounted, the collar 36 having a lever 38 projecting radially therefrom.

The doll eyes 40 and 42 are made of plastic material in the usual manner, the eyes being in the shape of spheres, each formed with simulated pupils 44, 46 and irises 48, 50 on the front surfaces thereof. The eyes 40 and 42 are also formed with respective eyelash portions 52 and 54, and with eyelid portions 56 and 58 disposed above said eyelash portions. The spherical doll eyes 40 and 42 are rotatably mounted on the frame 14 by pivot pins 60 and 62 which project therefrom, and the eys are interconnected in spaced relationship by a bar 64 which is connected to the rear surface of each of the eyes 40, 42.

A tension spring 66 is connected between the bar 64 and the frame 14, and biases the rear portion 68 of the bar 64 in a downward direction, thus pivoting the eyes 40 and 42 upward to an open position with the pupils 44, 46 and irises 48, 50 visible through eye socket apertures 70, 72 which are formed in the head member 12. This normal, open position of the eyes 40 and 42 is shown in FIGS. 1, 3 and 6. The rear portion 68 of the bar 64 is generally in line with the lever 38 which projects from the collar 36. Lever 38 and bar 64 constitute engaging means such that when the member 18 is rotated in a counter-clockwise direction, as shown by the arrow 74 in FIG. 3A, the end 76 of the lever 38 is rotated upward to a position in which it engages the bar 64 and lifts the rear end 68 thereof against the tension of spring 66. Lifting of the bar 64 causes the eyes 40 and 42 to pivot downwardly to the position shown in FIG. 3A, thus bringing the eyelids 56, 58 into registry with the eye socket apertures 70, 72, so that the eyes appear to be closed, as shown in FIG. 7.

Also mounted on an intermediate portion of the shaft 30 is a collar 78 which rides against the surface 80 of the frame 14 and aids in positioning the shaft 30. Mounted on the end 82 of the shaft 30 is a cylindrical member 84 which has an eccentrically mounted post 86 projecting rearwardly therefrom. The post 86 projects through an elongated horizontal slot 88 in a block 90, as shown in FIGS. 1 and 4, the block 90 being slideably mounted in the frame 14 by means of an upstanding shaft 92 secured to block 90 and extending upwardly through a guide plate 94, and also by means of depending shaft 96 secured to block 90 and extending through a guide member 98. The guide members 94 and 98 are both integrally formed as part of the frame 14.

The upper end 100 of the shaft 92 actuates a noise maker assembly 102 attached to a noise maker 102 which includes a suction cup 104 mounted on the end 100 of shaft 92 and bearing against a membrane 106 which is stretched across the bottom of a resonant chamber 108 supported by the frame 14. A pair of strings 110 and 112 extend respectively from opposite side portions 114 and 116 of the block 90, around respective circular guides 118 and 120, and are connected to cheek portions 122, 124 of the doll head 12.

The doll head 12 comprises a thin flexible resilient skin member 126 which covers a rigid inner support shell 128. The support shell 128 terminates at the edge 130, disposed just below the nose portion 132, and the edge 134 disposed just below the chin portion 136, thus leaving an unsupported area 138 of the skin member 126 in the area of the skin member 126 in the area of the mouth 26 and cheeks 122, 124, of the doll head 12. The cheek portions 122, 124 of the drinking doll 10 are thus unsupported and are extremely flexible.

When the member 18 is rotated in a clockwise direction, shown by the arrow 140 in FIG. 1, the cylindrical member 84 is rotated in the direction shown by the arrow 142, thus raising the block 90. This action is shown more clearly in FIGS. 4A and 5 which show the motion of the post 86 sliding within the elongated slot 88 and raising the block 90 in the direction shown by the arrow 144. Block 90 is an actuator member for string 110 and 112 and for shaft 92. Raising the block 90 places tension on the strings 110, 112 and draws the cheek portions 122, 124 inward, thus simulating the appearance of sucking. As the block 90 is raised, it also raises the upper shaft 92, causing the suction cup 104 to bear against the membrane 106 and deform the latter to the position 146 shown in broken lines in FIG. 2. Continued rotation of the member 18 in the clockwise direction brings the lever 38 into contact with a resilient pad 148 which lines the bottom surface 150 of a lever stop 152 connected to the frame 14. Contact of the lever 38 with the lever stop 152 limits the upward motion of the block 90. Rotation of the member 18 in the counter-clockwise direction to return the member 18 to its neutral position, lowers the block 90, releasing the tension on the strings 110, 112 and permitting the cheek portions 122, 124 to flex back to their normal positions shown in FIG. 2 and 6. Lowering the block 90 also draws the suction cup 104 downward, away from the membrane 106, and the inrush of air as the suction cup 104 leaves the membrane 106 creates a gulping sound. This action of the suction cup 104 in releasing the membrane 106 also sets the membrane 106 into vibration, thus creating a sound in the resonant chamber 108. The sound created by the inrush of air into the suction cup 104 and the sound created by the vibrating membrane 106 combine to simulate the sound of an infant sucking on a bottle. This sound is further conditioned by the inner surface 154 of the support shell 128 which acts as a reverberant chamber, and the sound exits through the eye sockets 70, 72 and the mouth aperture 24.

FIGS. 6 through 8 show the complete action of the drinking doll as viewed by a user. In FIG. 6 a simulated bottle 156 having a simulated nipple portion 158 which has an end 160 complementary in shape to the non-circular aperture 20 in the member 18, is about to be inserted in the mouth 26 of the doll head 12. In FIG. 7 the bottle 156 is rotated in a counter-clockwise direction, as shown by the arrow 162, and the doll eyes 40 and 42 close. In FIG. 8 the bottle 156 is rotated in a clockwise direction as shown by arrow 164, so that the eyes 40 and 42 open and the cheek portions 122, 124 of the doll head 12 are drawn inwardly simulating the appearance of sucking.

As shown in FIG. 6 the drinking doll also includes a wig or hood 168 attached to the head portion 10 and a body 170 which may be sewn stuffed in a conventional manner and clothed in a gown 172.

While a preferred embodiment of the present invention has been shown and described herein, it is obvious that numerous additions, changes and omissions may be made in such embodiment without departing from the spirit and scope of the invention.

What is claimed is:

1. A doll assembly comprising a hollow head portion having a mouth aperture and a pair of flexible cheek portions, a frame immovably mounted within said head portion, a rotatable member mounted on said frame for rotary movement about a transverse axis extending between the front and rear walls of the doll head portion, said rotatable member being positioned to be accessible through said mouth aperture, an actuator member movably mounted on said frame, means operatively coupling said rotatable member with said actuator member for movement of the latter to an actuating position when said rotatable member is turned in a first selected direction, first coupling means connecting said actuator member to said flexible cheek portions for flexing the latter inwardly when said actuator member is moved to said actuating position by turning movement of said rotatable member in said selected direction, said rotatable member having an end portion located adjacent to said mouth aperture, said end portion having an opening registering with said mouth aperture, and a bottle having a portion sized for insertion through said mouth aperture into coupling engagement with said rotatable member for rotation of the latter when said bottle is turned manually.

2. A doll assembly according to claim 1 which also includes noise generator means mounted on said frame and second coupling means connecting said noise generator means with said actuator member for operation of said noise generator means when said actuator member is moved to said actuating position.

3. A doll assembly according to claim 2 in which said noise generator means comprises a suction cup connected to said block, and a membrane mounted on said frame in alignment with said suction cup, said suction cup being movable with said block into engagement with said membrane when said rotatable member is turned in said first selection direction to operate said noise generator means.

4. A doll assembly according to claim 3 in which said noise generator means also includes a chamber mounted on said frame and having at least one open end, said membrane being stretched across the open end of said chamber.

5. A doll assembly according to claim 1 in which said hollow head portion has a pair of eye socket apertures, said assembly also including a pair of eyeball portions mounted on said frame adjacent said eye socket apertures, said eyeball portions being movable between a normally eye-open position and an eye-closed position, and actuating means operatively coupling said eyeball portions and said rotatable member for moving said eyeball portions from said eye-open position to said eye-closed position in response to rotation of said rotatable member in a second selected direction opposite to said first selected direction.

6. A doll assembly according to claim 4 in which said rotatable member is mounted on a shaft journalled in said frame, and in which a bar connects said eyeball portions said shaft having a lever projecting therefrom and aligned with said bar, said lever being positioned to engage said bar and move the latter in a direction to turn said eyeball portions to said eye-closed position in response to turning movement of said rotatable member in said second selected direction.

7. A doll assembly according to claim 1 in which said rotatable member is mounted on a shaft journalled in said frame, in which said actuator member comprises a block slidably mounted on said frame, in which said means coupling said rotatable member with said actuator member comprises an eccentric member mounted on said shaft and engaging said block, and in which said first coupling means comprises a pair of string members extending from said block to the respective cheek portions.

8. A doll assembly according to claim 5 which also includes a pair of spaced guide members mounted on said frame, each of said string members passing over a respective guide member.

* * * * *